US007569268B2

(12) United States Patent
Crkvenac et al.

(10) Patent No.: US 7,569,268 B2
(45) Date of Patent: Aug. 4, 2009

(54) CHEMICAL MECHANICAL POLISHING PAD

(75) Inventors: T. Todd Crkvenac, Hockessin, DE (US); Clyde A. Fawcett, Claymont, DE (US); Mary Jo Kulp, Newark, DE (US); Andrew Scott Lawing, Phoenix, AZ (US); Kenneth A. Prygon, Bear, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 11/699,775

(22) Filed: Jan. 29, 2007

(65) Prior Publication Data

US 2008/0182492 A1 Jul. 31, 2008

(51) Int. Cl.
*B32B 3/26* (2006.01)
*B24D 11/00* (2006.01)

(52) U.S. Cl. ..... 428/314.8; 428/315.5; 428/315.7; 428/317.9; 451/526; 451/527

(58) Field of Classification Search ..... 428/315.5, 428/315.7, 314.8; 451/41, 57
See application file for complete search history.

(56) References Cited

U.S. PATENT DOCUMENTS 5,578,362 A 11/1996 Reinhardt et al.
6,860,802 B1 3/2005 Vishwanathan et al.
6,899,612 B2 5/2005 Lawing
7,074,115 B2 7/2006 James et al.
7,169,030 B1 1/2007 Kulp
2003/0139122 A1 * 7/2003 Lawing ..... 451/288
2005/0079806 A1 * 4/2005 James et al. ..... 451/41
2005/0276967 A1 12/2005 Prasad
2006/0276109 A1 * 12/2006 Roy et al. ..... 451/41

OTHER PUBLICATIONS

Chemical-Mechanical Planarization of Semiconductor Materials, edited by M. R. Oliver, Springer, New York, NY, 2004, pp. 204-206.

* cited by examiner

*Primary Examiner*—Hai Vo
(74) *Attorney, Agent, or Firm*—Blake T. Biederman

(57) ABSTRACT

The polishing pad is suitable for planarizing at least one of semiconductor, optical and magnetic substrates. The polishing pad has an ultimate tensile strength of at least 3,000 psi (20.7 MPa) and polymeric matrix containing closed cell pores. The closed cell pores have an average diameter of 1 to 50 μm and represent 1 to 40 volume percent of the polishing pad. The pad texture has an exponential decay constant, τ, of 1 to 10 μm as a result of the natural porosity of the polymeric matrix and a surface texture developed by implementing periodic or continuous conditioning with an abrasive. The surface texture has a characteristic half height half width, $W_{1/2}$ that is less than or equal to the value of τ.

10 Claims, 5 Drawing Sheets

CHEMICAL MECHANICAL POLISHING PAD

BACKGROUND OF THE INVENTION

This specification relates to polishing pads useful for polishing and planarizing substrates, such as semiconductor substrates or magnetic disks.

Polymeric polishing pads, such as polyurethane, polyamide, polybutadiene and polyolefin polishing pads represent commercially available materials for substrate planarization in the rapidly evolving electronics industry. Electronics industry substrates requiring planarization include silicon wafers, patterned wafers, flat panel displays and magnetic storage disks. In addition to planarization, it is essential that the polishing pad not introduce excessive numbers of defects, such as scratches or other wafer non-uniformities. Furthermore, the continued advancement of the electronics industry is placing greater demands on the planarization and defectivity capabilities of polishing pads.

For example, the production of semiconductors typically involves several chemical mechanical planarization (CMP) processes. In each CMP process, a polishing pad in combination with a polishing solution, such as an abrasive-containing polishing slurry or an abrasive-free reactive liquid, removes excess material in a manner that planarizes or maintains flatness for receipt of a subsequent layer. The stacking of these layers combines in a manner that forms an integrated circuit. The fabrication of these semiconductor devices continues to become more complex due to requirements for devices with higher operating speeds, lower leakage currents and reduced power consumption. In terms of device architecture, this translates to finer feature geometries and increased numbers of metallization levels. These increasingly stringent device design requirements are driving the adoption of smaller and smaller line spacing with a corresponding increase in pattern density. The devices' smaller scale and increased complexity have led to greater demands on CMP consumables, such as polishing pads and polishing solutions. In addition, as integrated circuits' feature sizes decrease, CMP-induced defectivity, such as, scratching becomes a greater issue. Furthermore, integrated circuits' decreasing film thickness requires improvements in defectivity while simultaneously providing acceptable topography to a wafer substrate; these topography requirements demand increasingly stringent planarity, line dishing and small feature array erosion polishing specifications.

Historically, cast polyurethane polishing pads have provided the mechanical integrity and chemical resistance for most polishing operations used to fabricate integrated circuits. Typical pads rely upon a combination of porosity, macrogrooves or perforations and diamond conditioning to create a surface texture that improves wafer uniformity and material removal rate. Diamond conditioning may occur on a periodic "ex situ" basis or a continuous "in situ" basis to maintain steady state polishing performance—the absence of conditioning will result in the pad glazing and losing its polishing ability. As polishing standards have tightened over the years, the vast majority of fabs rely upon in situ conditioning to maintain acceptable removal rates. In addition, fabs have moved to more aggressive diamond conditioning to achieve increased stability and increased removal rates.

Lawing, in U.S. Pat. No. 6,899,612, discloses a surface morphology through controlled diamond conditioning for optimizing a polishing pad's planarization performance. In addition to optimizing conditioning for polishing performance, next generation polishing pads contain specialized polymer matrices that achieve a combination of excellent planarization and low wafer defectivity. Unfortunately, some of these high performance polishing pads lack acceptable polishing performance, such as removal rate for the most demanding polishing applications. There is a desire for improving the polishing performance of these high performance polishing pads.

STATEMENT OF INVENTION

An aspect of the invention provides a polishing pad suitable for planarizing at least one of semiconductor, optical and magnetic substrates, the polishing pad having an ultimate tensile strength of at least 3,000 psi (20.7 MPa), a polishing surface and a polymeric matrix, the polymeric matrix having closed cell pores, the polishing surface having opened pores, the closed cell pores having an average diameter of 1 to 50 μm, being 1 to 40 volume percent of the polishing pad at a location below the polishing surface and characterized by an exponential decay constant, $\tau$, of 1 to 10 μm and having a texture developed by implementing periodic or continuous conditioning with an abrasive having a characteristic half height half width, $W_{1/2}$, less than or equal to the value of $\tau$.

Another aspect of the invention provides a polishing pad suitable for planarizing at least one of semiconductor, optical and magnetic substrates, the polishing pad having an ultimate tensile strength of at least 4,000 psi (27.6 MPa), a polishing surface and a polymeric matrix, the polymeric matrix having closed cell pores, the polishing surface having opened pores, the closed cell pores having an average diameter of 1 to 50 μm, being 2 to 30 volume percent of the polishing pad at a location below the polishing surface and characterized by an exponential decay constant, $\tau$, of 1 to 5 μm and having a texture developed by implementing periodic or continuous conditioning with an abrasive having a characteristic half height half width, $W_{1/2}$, less than or equal to the value of $\tau$.

DETAILED DESCRIPTION

The invention provides a polishing pad suitable for planarizing at least one of semiconductor, optical and magnetic substrates. It has been discovered that ultra-fine conditioning increases removal rate for polishing pads having a high ultimate tensile strength, and relatively small concentration of closed cell pores or micropores. For purposes of this specification, the tensile strength of the bulk material represents the properties of the polymer with porosity, such as a porous polyurethane polymer of the matrix containing porosity from gas bubbles or polymeric microspheres. The channels have an average width and depth and connect at least a portion of opened closed cells. Periodic or continuous conditioning with an abrasive forms additional channels in the polymeric matrix and maintains the polishing and removal rate in a relatively steady polishing state. These polishing pads are particularly suitable for polishing and planarizing STI applications, such as HDP/SiN, TEOS/SiN or SACVD/SiN.

Figure 1:
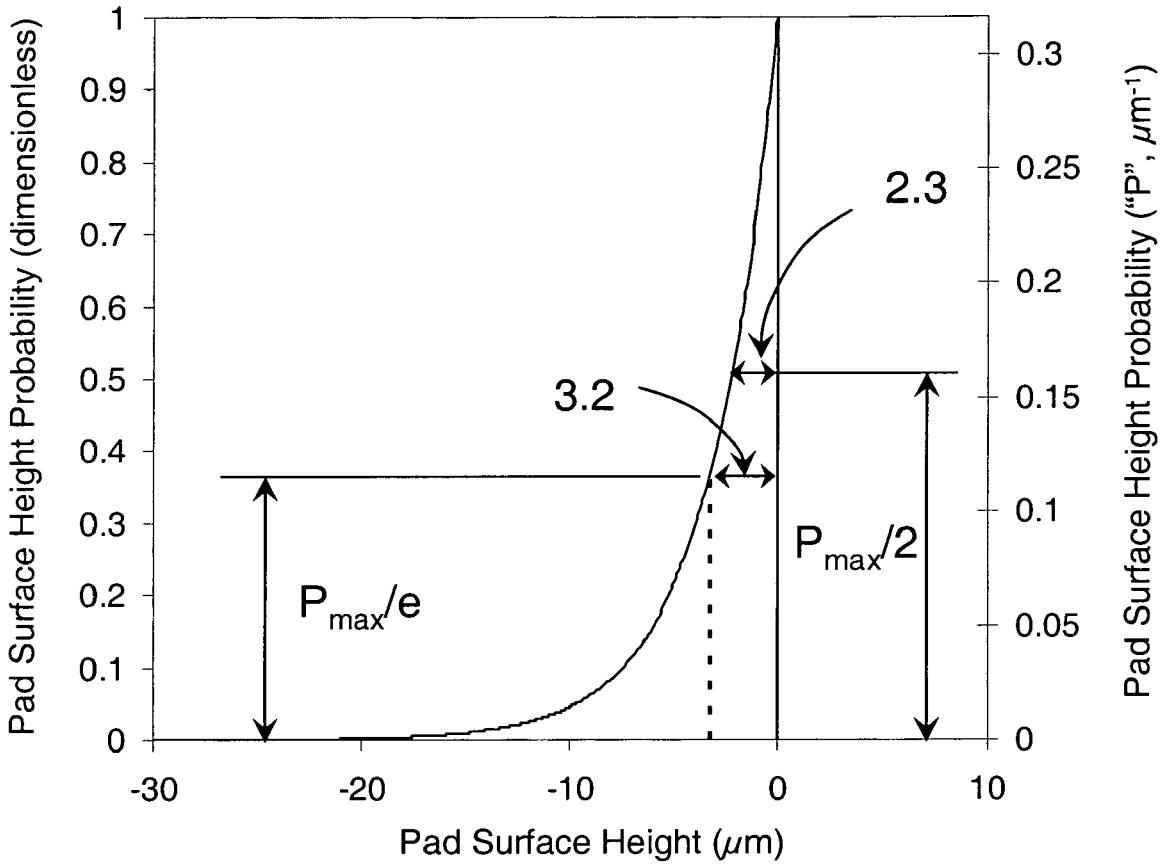
FIG. 1 provides the natural porosity distribution of a high tensile strength polishing pad.

The natural porosity of a polishing pad can be imagined as the texture that would result from a perfect cut through the porous material. The natural porosity of a polishing pad can be approximated as a truncated exponential distribution. The natural porosity distribution of a pad can be estimated from pad surface height data such as that obtained using a Veeco NT3300 Vertical Scanning Interferometer. Referring to FIG. 1 the equation that describes the approximate natural porosity of the low porosity pad 1 (See Examples) is:

$$P=P_{max}\cdot e^{(x/\tau)}$$

P=pad surface height probability

X=pad surface height $P_{max}$=scaling constant

τ=decay constant

Where $P_{max}$ is a scaling constant with units of length$^{-1}$ and represents the pad surface height probability at x=0 for a distribution normalized to a total area of 1. For Pad 1 of the examples, $P_{max}$=0.316 μm$^{-1}$ and the exponential decay constant, τ=3.2 μm. It has been found that a decay constant, τ, of 1 to 10 μm provides excellent polishing results. Preferably, the decay constant, τ, is 1 to 5 μm.

The cutting characteristic of a pad conditioner can be approximated by a normal distribution with a characteristic half height width, or more conveniently with a half height half width, $W_{1/2}$.

The texture of a conditioned polishing pad is determined by a combination of the natural porosity and the conditioner cutting characteristic. A conditioner cutting characteristic can be defined to be compatible with a natural pad porosity if the characteristic half height half width of the conditioner is less than the characteristic exponential decay constant of the pad material.

Table 1 lists typical values of the characteristic constants of high and low tensile strength polishing pads, 44 μm and 180 μm conditioners and the resulting roughness from the implementation of the respective conditioners on the respective pads.

TABLE 1

| Pad/Conditioner | Ra (μm) | τ (μm) | $W_{1/2}$ (μm) |
|---|---|---|---|
| Low Tensile Strength/44 μm* | 6.60 | 10.3 | 2.75 |
| Low Tensile Strength/180 μm** | 6.82 | 10.3 | 7.5 |
| High Tensile Strength/44 μm* | 2.41 | 3.2 | 2.75 |
| High Tensile Strength/180 μm** | 4.57 | 3.2 | 7.5 |

High Tensile Strength represents pad 1 and Low Tensile Strength represents comparative pad A from the Examples.
44 μm* = SPD01 from Kinik Co.; Diamond size: 325 Mesh (44 μm); Diamond spacing: 150 μm (density = ~44/mm$^2$); and Shape: fine.
180 μm** = AD3CG-181060 from Kinik Co.; Diamond size: nominally 180 μm; Diamond spacing: 150 μm (density = ~2.8/mm$^2$); and Shape: cubic-octahedral.

Referring to Table 1, note that the low tensile strength pad is compatible with both the 44 μm and 180 μm conditioners since both values of $W_{1/2}$ are less than the value of τ for the low tensile strength pad. Additionally, note that only the 44 μm conditioner is compatible with the high tensile strength pad since the value of $W_{1/2}$ for the 180 μm conditioner is greater than the value of τ for the high tensile strength pad. Also note that the roughness values for the low tensile strength pad are similar regardless of the conditioner used, while the roughness value for the high tensile strength pad is significantly increased when the incompatible 180 μm conditioner is used.

Figure 2:
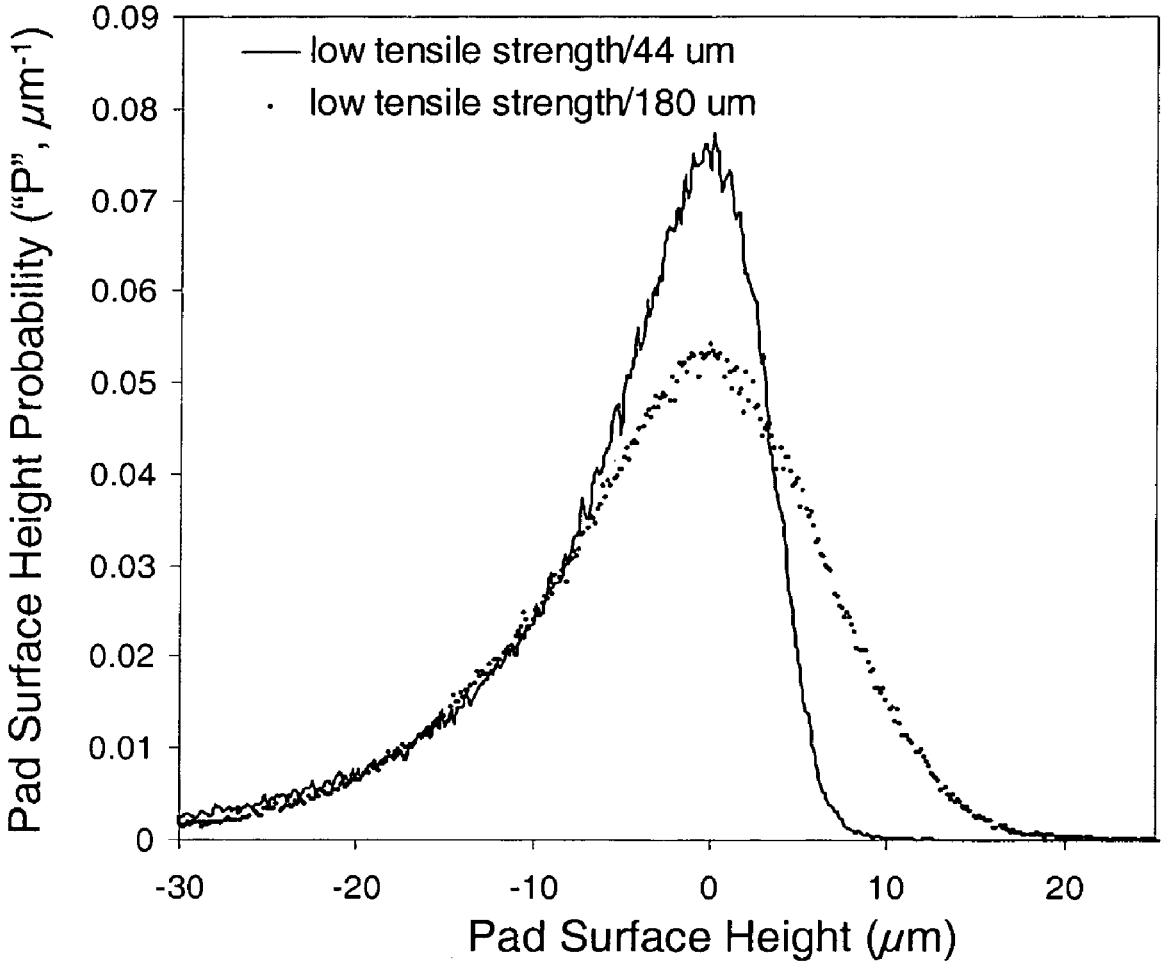
FIG. 2 is a plot of pad surface height probability versus pad surface height for a low tensile strength polyurethane polishing pad using 44 and 180 μm diamond conditioning disks.

Referring to FIG. 2, which represents pad surface data obtained using a Veeco NT3300 Vertical Scanning Interferometer, note that neither conditioner implemented on the low tensile strength pad results in significant changes to the negative tail of the pad surface height distribution. Also note that the 180 μm conditioner, due to the higher characteristic $W_{1/2}$ value, results in a comparative widening of the positive front of the pad surface height distribution.

Figure 3:
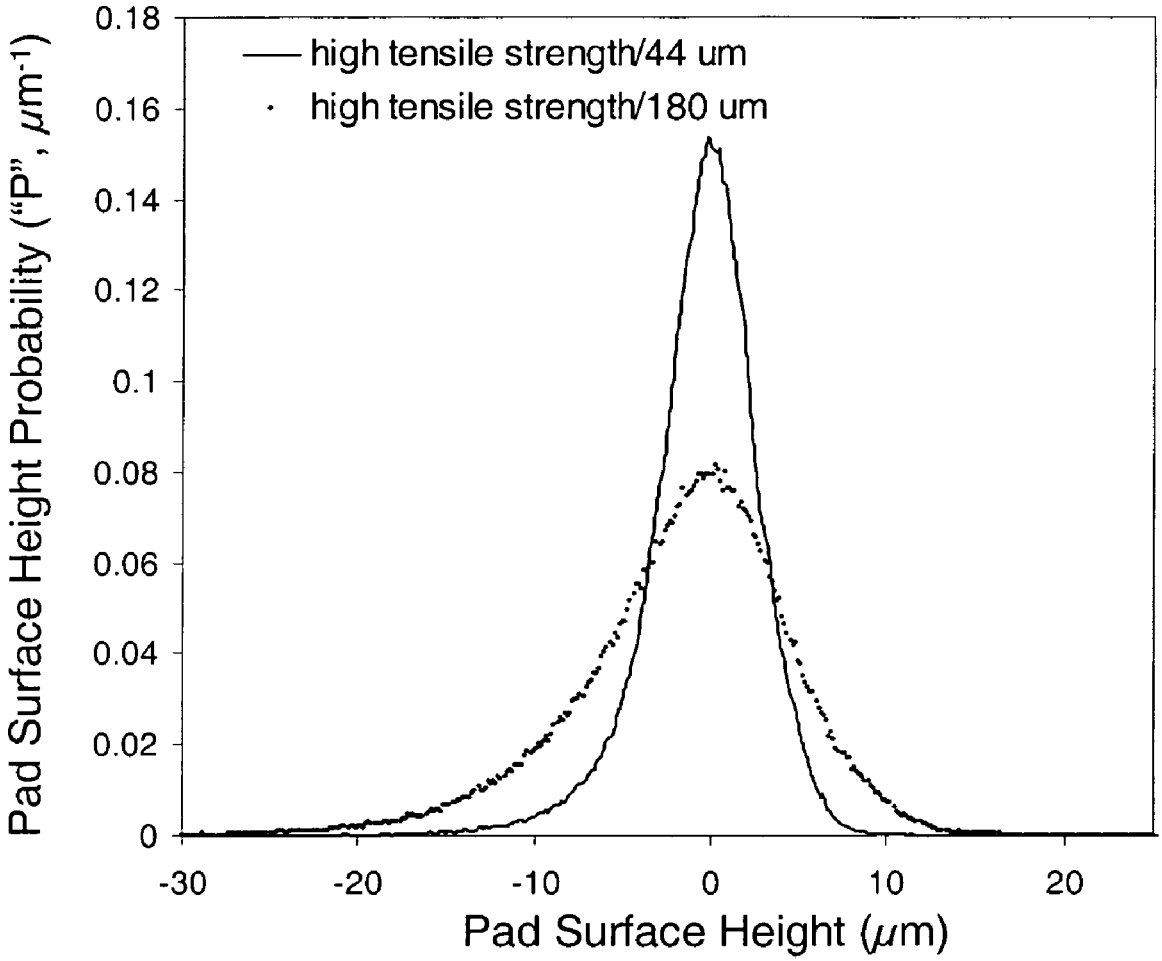
FIG. 3 is a plot of pad surface height probability versus pad surface height for a high tensile strength polyurethane polishing pad using 44 and 180 μm diamond conditioning disks.

Referring to FIG. 3, which represents pad surface data obtained using a Veeco NT3300 Vertical Scanning Interferometer, note that the compatible 44 μm conditioner, when implemented on the high tensile strength pad, results in a roughly symmetric pad surface height distribution due to the similar values of $W_{1/2}$ and τ for this pairing. By contrast, the pairing of the incompatible 180 μm conditioner results in a comparative widening of both the positive front and the negative tail due to the larger $W_{1/2}$ value. This more fundamental modification to the pad texture due to the comparatively larger $W_{1/2}$ is what makes the conditioner incompatible with the natural porosity.

It is also important to note that the textural differences resulting from the various pad and conditioner combinations have significant implications on the planarization performance. With respect to the low tensile strength pad texture, implementation of the 44 μm conditioner, with its comparatively lower characteristic $W_{1/2}$ value, results in superior planarization compared to the pairing of low tensile strength pad and the 180 μm conditioner. The pairing of the high tensile strength pad with the 44 μm conditioner with its combination of comparatively low $W_{1/2}$ and τ values, results in the best planarization performance of all of the combinations in this example.

Figure 4:
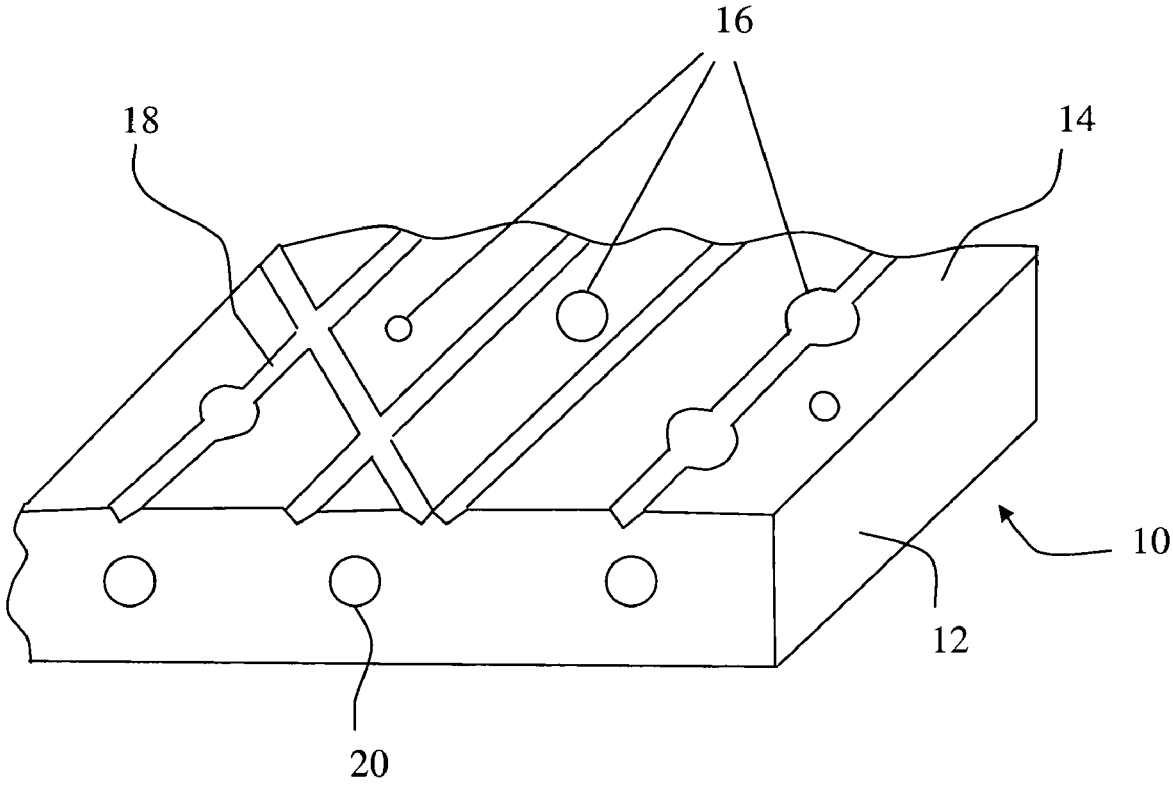
FIG. 4 represents a schematic perspective view of a polishing pad with portions broken away illustrating closed cell pores and channels.

Referring to FIG. 4, polymeric polishing pad 10 includes polymeric matrix 12 and top polishing surface 14. The polishing surface 14 includes opened cell pores 16 within the polymeric matrix 12 and channels 18 connecting the opened cells 16. Channels 18 may be in a parallel configuration or in a random overlapping configuration, such as that formed with a rotating abrasive disk. For example, it is possible for single channel 18 to intersect several other channels 18. The closed cell pores 20 represent 1 to 40 volume percent of the polishing pad 10 at a location below the polishing surface 14. As the polishing surface 14 of the polishing pad 10 wears, the closed cells 20 become opened cells 16 that contribute to polishing.

Typically, conditioning with a hard surface, such as a diamond conditioning disk forms channels 18 during polishing. For example, periodic "ex situ" or continuous "in situ" conditioning with an abrasive forms additional channels 18 in the polymeric matrix 12. Although conditioning can function in an ex situ manner, such as for 30 seconds after each wafer or in an in situ manner, in situ conditioning provides the advantage of establishing steady-state polishing conditions for improved control of removal rate. The conditioning typically increases the polishing pad removal rate and prevents the decay in removal rate typically associated with the wear of a polishing pad. It is important to note that channels may not always be visible on a conditioned naturally porous material due to its non-continuous structure, but the description of channel creation is useful in visualizing how surface texture is formed on a conditioned pad. It is also useful to note that the geometry of the theoretical channels are related to the characteristic half height half width, $W_{1/2}$, for the particular conditioner or conditioning process. In addition to conditioning, grooves and perforations can provide further benefit to the distribution of slurry, polishing uniformity, debris removal and substrate removal rate.

It is possible to condition or cut the polishing pads with multiple hard abrasive substances, such as diamonds, borides, nitrides and carbides—diamonds represent the preferred abrasive. In addition, several factors are import in selecting the proper conditioning to achieve the desired roughness profile. For example, diamond shape, diamond size, diamond density, tool settings and conditioner downforce all impact surface roughness and the roughness profile. A diamond size of 10 to 300 μm is useful for achieving acceptable polishing surfaces for the high tensile strength pads. Within this range, a diamond size of 20 to 100 μm and 190 to 250 μm are advantageous for the high tensile strength polishing pads. And the diamond size range of 20 to 100 μm is the most useful for the high tensile strength polishing pads for stable removal at high rates.

The polymer is effective for forming porous polishing pads. For purposes of this specification, porous polishing pads include gas-filled particles, gas-filled spheres and voids formed from other means, such as mechanically frothing gas into a viscous system, injecting gas into the polyurethane melt, introducing gas in situ using a chemical reaction with gaseous product, or decreasing pressure to cause dissolved gas to form bubbles. The pores have an average diameter of 1 to 50 μm. Preferably, the pores have an average diameter of 10 to 45 μm and most preferably, between 10 and 30 μm. In addition, the volume of the pores is 1 to 40 volume percent; and preferably to 2 to 30 volume percent. Most preferably, the pores occupy 2 to 25 volume percent of the matrix.

The channels typically have an average width and depth less than or equal to the average diameter of the closed cell pores. For example, channels may have an average width of 1.5 μm and a depth of 2 μm. Most preferably, width and depth of the channels remain between 0.5 and 5 μm. Typically, a scanning electron microscope (SEM) represents the best means to measure channel width and depth.

The polymeric polishing pads' ultimate tensile strength facilitates durability and planarization required for demanding polishing application. In particular, the polishing pads with high tensile strength tend to facilitate silicon oxide removal rate. The polishing pad has an ultimate tensile strength of at least 3,000 psi (20.7 MPa) or more preferably, at least 4,000 psi (27.6 MPa). Preferably, the polymeric polishing pad has an ultimate tensile strength of 4,000 to 14,000 psi (27.6 to 96.5 MPa). Most preferably, the polymeric polishing pad has an ultimate tensile strength of 4,000 to 9,000 psi (27.6 to 62 MPa) is particularly useful for polishing wafers. The polymeric polishing pad's elongation at break is optionally at least 100 percent and typically between 100 and 300 percent. The test method set forth in ASTM D412 (Version D412-02) is particularly useful for determining ultimate tensile strength and elongation at break.

Typical polymeric polishing pad materials include polycarbonate, polysulphone, nylon, ethylene copolymers, polyethers, polyesters, polyether-polyester copolymers, acrylic polymers, polymethyl methacrylate, polyvinyl chloride, polycarbonate, polyethylene copolymers, polybutadiene, polyethylene imine, polyurethanes, polyether sulfone, polyether imide, polyketones, epoxies, silicones, copolymers thereof and mixtures thereof. Preferably, the polymeric material is a polyurethane with or without a cross-linked structure. For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof.

Cast polyurethane polishing pads are suitable for planarizing semiconductor, optical and magnetic substrates. The pads' particular polishing properties arise in part from a prepolymer reaction product of a prepolymer polyol and a polyfunctional isocyanate. The prepolymer product is cured with a curative agent selected from the group comprising curative polyamines, curative polyols, curative alcohol amines and mixtures thereof to form a polishing pad. It has been discovered that controlling the ratio of the curative agent to the unreacted NCO in the prepolymer reaction product can improve porous pads' defectivity performance during polishing.

Most preferably the polymeric material is a polyurethane. For purposes of this specification, "polyurethanes" are products derived from difunctional or polyfunctional isocyanates, e.g. polyetherureas, polyesterureas, polyisocyanurates, polyurethanes, polyureas, polyurethaneureas, copolymers thereof and mixtures thereof. An approach for controlling a pad's polishing properties is to alter its chemical composition. In addition, the choice of raw materials and manufacturing process affects the polymer morphology and the final properties of the material used to make polishing pads.

Preferably, urethane production involves the preparation of an isocyanate-terminated urethane prepolymer from a polyfunctional aromatic isocyanate and a prepolymer polyol. For purposes of this specification, the term prepolymer polyol includes diols, polyols, polyol-diols, copolymers thereof and mixtures thereof. Preferably, the prepolymer polyol is selected from the group comprising polytetramethylene ether glycol [PTMEG], polypropylene ether glycol [PPG], ester-based polyols, such as ethylene or butylene adipates, copolymers thereof and mixtures thereof. Example polyfunctional aromatic isocyanates include 2,4-toluene diisocyanate, 2,6-toluene diisocyanate, 4,4'-diphenylmethane diisocyanate, naphthalene-1,5-diisocyanate, tolidine diisocyanate, paraphenylene diisocyanate, xylylene diisocyanate and mixtures thereof. The polyfunctional aromatic isocyanate contains less than 20 weight percent aliphatic isocyanates, such as 4,4'-dicyclohexylmethane diisocyanate, isophorone diisocyanate and cyclohexanediisocyanate. Preferably, the polyfunctional aromatic isocyanate contains less than 15 weight percent aliphatic isocyanates and more preferably, less than 12 weight percent aliphatic isocyanate.

Example prepolymer polyols include polyether polyols, such as, poly(oxytetramethylene)glycol, poly(oxypropylene) glycol and mixtures thereof, polycarbonate polyols, polyester polyols, polycaprolactone polyols and mixtures thereof. Example polyols can be mixed with low molecular weight polyols, including ethylene glycol, 1,2-propylene glycol, 1,3-propylene glycol, 1,2-butanediol, 1,3-butanediol, 2-methyl-1,3-propanediol, 1,4-butanediol, neopentyl glycol, 1,5-pentanediol, 3-methyl-1,5-pentanediol, 1,6-hexanediol, diethylene glycol, dipropylene glycol, tripropylene glycol and mixtures thereof.

Preferably the prepolymer polyol is selected from the group comprising polytetramethylene ether glycol, polyester polyols, polypropylene ether glycols, polycaprolactone polyols, copolymers thereof and mixtures thereof. If the prepolymer polyol is PTMEG, copolymer thereof or a mixture thereof, then the isocyanate-terminated reaction product preferably has a weight percent unreacted NCO range of 8.0 to 15.0 wt. %. For polyurethanes formed with PTMEG or PTMEG blended with PPG, the most preferable weight percent NCO is a range of 8.0 to 10.0 Particular examples of PTMEG family polyols are as follows: Terathane® 2900, 2000, 1800, 1400, 1000, 650 and 250 from Invista; Polymeg® 2900, 2000, 1000, 650 from Lyondell; PolyTHF® 650, 1000, 2000 from BASF, and lower molecular weight species such as 1,2-butanediol, 1,3-butanediol, and 1,4-butanediol. If the prepolymer polyol is a PPG, copolymer thereof or a mixture thereof, then the isocyanate-terminated reaction product most preferably has a weight percent unreacted NCO range of 7.9 to 15.0 wt. %. Particular examples of PPG polyols are as follows: Arcol® PPG-425, 725, 1000, 1025, 2000, 2025, 3025 and 4000 from Bayer; Voranol® 1010L, 2000L, and P400 from Dow; Desmophen® 1110BD, Acclaim® Polyol 12200, 8200, 6300, 4200, 2200 both product lines from Bayer If the prepolymer polyol is an ester, copolymer thereof or a mixture thereof, then the isocyanate-terminated reaction product most preferably has a weight percent unreacted NCO range of 6.5 to 13.0. Particular examples of ester polyols are as follows: Millester 1, 11, 2, 23, 132, 231, 272, 4, 5, 510, 51, 7, 8, 9, 10, 16, 253, from Polyurethane Specialties Company, Inc.; Desmophen® 1700, 1800, 2000, 2001KS, 2001K$^2$, 2500, 2501, 2505, 2601, PE65B from Bayer; Rucoflex S-1021-70, S-1043-46, S-1043-55 from Bayer.

Typically, the prepolymer reaction product is reacted or cured with a curative polyol, polyamine, alcohol amine or mixture thereof. For purposes of this specification, polyamines include diamines and other multifunctional amines. Example curative polyamines include aromatic diamines or polyamines, such as, 4,4'-methylene-bis-o-chloroaniline [MBCA], 4,4'-methylene-bis-(3-chloro-2,6-diethylaniline) [MCDEA]; dimethylthiotoluenediamine; trimethyleneglycol di-p-aminobenzoate; polytetramethyleneoxide di-p-aminobenzoate; polytetramethyleneoxide mono-p-aminobenzoate; polypropyleneoxide di-p-aminobenzoate; polypropyleneoxide mono-p-aminobenzoate; 1,2-bis(2-aminophenylthio)ethane; 4,4'-methylene-bis-aniline; diethyltoluenediamine; 5-tert-butyl-2,4- and 3-tert-butyl-2,6-toluenediamine; 5-tert-amyl-2,4- and 3-tert-amyl-2,6-toluenediamine and chlorotoluenediamine. Optionally, it is possible to manufacture urethane polymers for polishing pads with a single mixing step that avoids the use of prepolymers.

The components of the polymer used to make the polishing pad are preferably chosen so that the resulting pad morphology is stable and easily reproducible. For example, when mixing 4,4'-methylene-bis-o-chloroaniline [MBCA] with diisocyanate to form polyurethane polymers, it is often advantageous to control levels of monoamine, diamine and triamine. Controlling the proportion of mono-, di- and triamines contributes to maintaining the chemical ratio and resulting polymer molecular weight within a consistent range. In addition, it is often important to control additives such as anti-oxidizing agents, and impurities such as water for consistent manufacturing. For example, since water reacts with isocyanate to form gaseous carbon dioxide, controlling the water concentration can affect the concentration of carbon dioxide bubbles that form pores in the polymeric matrix. Isocyanate reaction with adventitious water also reduces the available isocyanate for reacting with chain extender, so changes the stoichiometry along with level of crosslinking (if there is an excess of isocyanate groups) and resulting polymer molecular weight.

The polyurethane polymeric material is preferably formed from a prepolymer reaction product of toluene diisocyanate and polytetramethylene ether glycol with an aromatic diamine. Most preferably the aromatic diamine is 4,4'-methylene-bis-o-chloroaniline or 4,4'-methylene-bis-(3-chloro-2,6-diethylaniline). Preferably, the prepolymer reaction product has a 6.5 to 15.0 weight percent unreacted NCO. Examples of suitable prepolymers within this unreacted NCO range include: Airthane® prepolymers PET-70D, PHP-70D, PET-75D, PHP-75D, PPT-75D, PHP-80D manufactured by Air Products and Chemicals, Inc. and Adiprene® prepolymers, LFG740D, LF700D, LF750D, LF751D, LF753D, L325 manufactured by Chemtura. In addition, blends of other prepolymers besides those listed above could be used to reach to appropriate % unreacted NCO levels as a result of blending. Many of the above-listed prepolymers, such as, LFG740D, LF700D, LF750D, LF751D, and LF753D are low-free isocyanate prepolymers that have less than 0.1 weight percent free TDI monomer and have a more consistent prepolymer molecular weight distribution than conventional prepolymers, and so facilitate forming polishing pads with excellent polishing characteristics. This improved prepolymer molecular weight consistency and low free isocyanate monomer give a more regular polymer structure, and contribute to improved polishing pad consistency. For most prepolymers, the low free isocyanate monomer is preferably below 0.5 weight percent. Furthermore, "conventional" prepolymers that typically have higher levels of reaction (i.e. more than one polyol capped by a diisocyanate on each end) and higher levels of free toluene diisocyanate prepolymer should produce similar results. In addition, low molecular weight polyol additives, such as, diethylene glycol, butanediol and tripropylene glycol facilitate control of the prepolymer reaction product's weight percent unreacted NCO.

In addition to controlling weight percent unreacted NCO, the curative and prepolymer reaction product typically has an OH or $NH_2$ to unreacted NCO stoichiometric ratio of 85 to 120 percent, preferably 87 to 115 percent; and most preferably, it has an OH or $NH_2$ to unreacted NCO stoichiometric ratio of greater than 90 to 110 percent. This stoichiometry could be achieved either directly, by providing the stoichiometric levels of the raw materials, or indirectly by reacting some of the NCO with water either purposely or by exposure to adventitious moisture.

If the polishing pad is a polyurethane material, then the polishing pad preferably has a density of 0.4 to 1.3 g/cm$^3$. Most preferably, polyurethane polishing pads have a density of 0.5 to 1.25 g/cm$^3$.

EXAMPLES

Example 1

The polymeric pad materials were prepared by mixing various amounts of isocyanates as urethane prepolymers with 4,4'-methylene-bis-o-chloroaniline [MBCA] at 50° C. for the prepolymer and 116° C. for MBCA. In particular, various toluene diiosocyanate [TDI] with polytetramethylene ether glycol [PTMEG] prepolymers provided polishing pads with different properties. The urethane/polyfunctional amine mixture was mixed with the hollow polymeric microspheres (EXPANCEL® 551DE20d60 or 551DE40d42 manufactured by AkzoNobel) either before or after mixing the prepolymer with the chain extender. The microspheres had a weight average diameter of 15 to 50 μm, with a range of 5 to 200 μm, and were blended at approximately 3,600 rpm using a high shear mixer to evenly distribute the microspheres in the mixture. The final mixture was transferred to a mold and permitted to gel for about 15 minutes.

The mold was then placed in a curing oven and cured with a cycle as follows: thirty minutes ramped from ambient temperature to a set point of 104° C., fifteen and one half hours at 104° C. and two hours with a set point reduced to 21° C. The molded article was then cut or "skived" into thin sheets and macro-channels or grooves were machined into the surface at room temperature—skiving at higher temperatures may improve surface roughness and thickness variation across the pad. As shown in the Tables, samples 1 to 6 represent polishing pads of the invention and samples A to E represent comparative examples.

TABLE 2

| Pad | Prepolymer | Stoichiometry (%) | Nominal Pore Size, (μm) | Calculated Pore Volume, (%) | Tensile strength at break, ASTM D412-02 (psi/MPa) | Elongation at break, ASTM D412-02 (%) |
|---|---|---|---|---|---|---|
| 1 | LF750D | 105 | 20 | 19 | 4500/31 | 210 |
| 2 | LF750D | 105 | 40 | 19 | 4200/29 | 180 |
| 3 | LF750D | 85 | 20 | 18 | 4900/34 | 130 |
| 4 | LF750D | 105 | 20 | 35 | 3300/23 | 145 |
| 5 | LF750D | 95 | 20 | 17 | 5300/36 | 180 |
| 6 | LF750D | 105 | 20 | 11 | 5500/38 | 250 |
| A | L325 | 87 | 40 | 32 | 2700/19 | 125 |
| B | LF750D | 85 | 40 | 41 | 2600/18 | 110 |
| C | LF750D | 85 | 20 | 41 | 2600/18 | 75 |
| D | LF750D | 105 | 20 | 50 | 2200/15 | 90 |
| E | LF750D | 120 | 20 | 19 | 2900/20 | 125 |

All samples contained Adiprene ™ LF750D urethane prepolymer having 8.75-9.05 wt % NCO from Chemtura-the formulation contains a blend of TDI and PTMEG. Comparative Sample A corresponds to IC1010 ™ pads manufactured by Rohm and Haas Electronic Materials CMP Technologies contained Adiprene ™ L325 urethane prepolymer having 8.95-9.25 wt % NCO from Chemtura-the formulation contains a $H_{12}$MDI/TDI-PTMEG blend. Preparing pad samples by placing them in 50% relative humidity forfive days at 25° C. before testing improved the repeatability of the tensile tests.

Table 2 illustrates the elongation to break of polyurethanes cast with different stoichiometric ratios and varied amounts of polymeric microspheres. The different stoichiometric ratios control the amount of the polyurethane's crosslinking and the polymer's molecular weight. Furthermore, increasing the quantity of polymeric microspheres generally decreases physical properties, but improves polishing defectivity performance.

All pads were polished on the Applied Materials Mirra polisher in conjunction with a commercial CMPT slurry known as Celexis™ 94S. All pads were polished using a platen speed of 123 rpm, a carrier speed of 44 rpm, a pressure of 2.7 psi and a slurry flow rate of 85 ml/min. All pads were pre-conditioned using the Kinik™ conditioning discs listed in Table 3. As is standard operating procedure in this application, in-situ conditioning with the specified disc was performed during polishing runs on each of the pads as well. Table 3 includes the KLA—Tencor Spectra FX200 metrology data for TEOS removal rates in Å/min, generated through polishing the wafers with the experimental pad formulations.

TABLE 3

| | Stoichiometry | 44 μm* Conditioner (Å/min) | 180 μm** Conditioner (Å/min) | Tensile Strength at Break, ASTM D412-02 (psi/MPa) | Elongation at Break, ASTM D412-02 (%) |
|---|---|---|---|---|---|
| 1 | 105 | 2371 | 2313 | 4500/31 | 210 |
| 3 | 85 | 1983 | | 4900/34 | 130 |
| 5 | 95 | 2392 | 2136 | 5300/36 | 180 |
| E | 120 | 2274 | 2624 | 2900/20 | 125 |

44 μm* = SPD01 from Kink Co.; Diamond size: 325 Mesh (44 μm); Diamond spacing: 150 μm (density = ~44/mm$^2$); and Shape: fine.
180 μm** = AD3CG-181060 from Kinik Co.; Diamond size: nominally 180 μm; Diamond spacing: 150 μm (density = ~2.8/mm$^2$); and Shape: cubic-octahedral.

Figure 5:
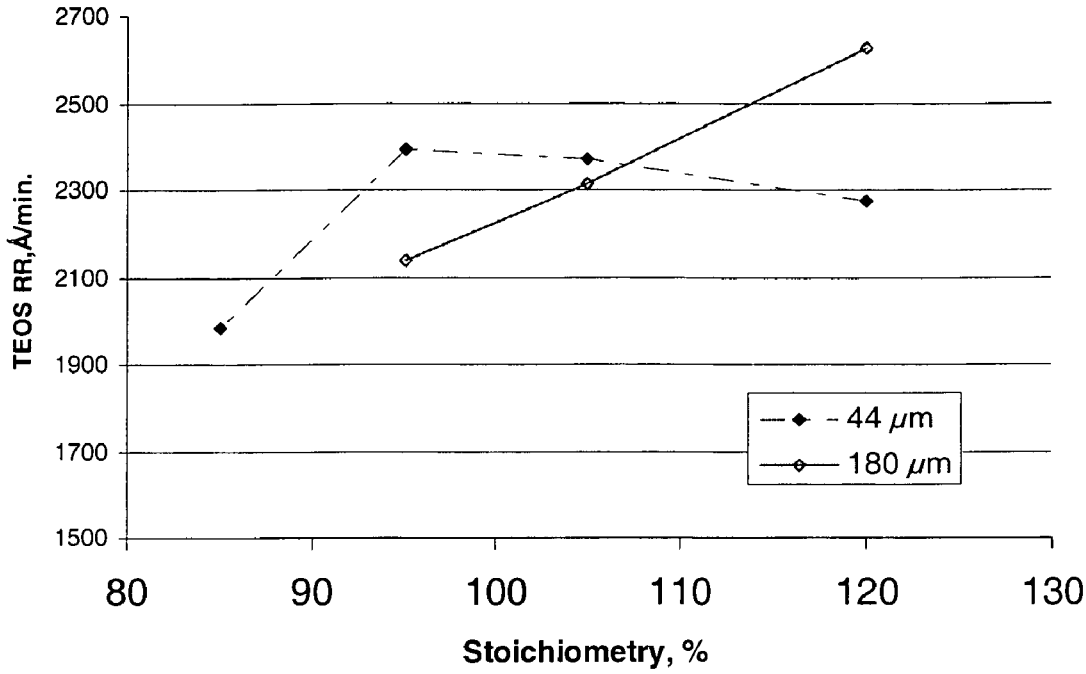
FIG. 5 represents a plot of removal rate versus stoichiometry for a conventional and an ultra-fine conditioner disk.

FIG. 5 in combination with Table 3 illustrate that the 44 μm conditioner provides an increase in removal rate for polishing pads having a tensile strength in excess of 2,900 psi (20 MPa) and an elongation at break above 125%. It is counter-intuitive for a polishing pad with fine conditioning to increase removal rate in comparison to a polishing pad with more aggressive conditioning. In addition, testing has shown that the removal rate is stable over a large number of wafers.

Example 2

The data in Table 4 represents dishing performance over a range of oxide isolation trench widths for experimental pad formulations that contain a range of pore volume percentages. The patterned wafers used to generate the data for all pads types utilized an MIT 864 mask pattern. This pattern includes HDP oxide trench features of various pitches and densities. The equipment, methodology, processes and procedures used on the experimental pads which polished the MIT 864 wafers, were the same as those described in conjunction with the data in Table 3 above. The dishing was calculated by measuring the remaining oxide thickness in the trenches specified in Table 4. These measurements were made on the KLA-Tencor FX200 thin film metrology tool.

TABLE 4

| Formulation | Pore vol, % | 44 μm* Diamond 50 μm line (Å) | 180 μm** Diamond 50 μm (Å) | 44 μm* Diamond 100 μm line (Å) | 180 μm** Diamond 100 μm (Å) | 44 μm* Diamond 500 μm line (Å) | 180 μm** Diamond 500 μm (Å) |
|---|---|---|---|---|---|---|---|
| 1 | 19 | 194 | 336 | 316 | 570 | 402 | 897 |
| 4 | 35 | 224 | 371 | 404 | 595 | 547 | 883 |
| 6 | 11 | 237 | 109 | 360 | 268 | 535 | 355 |
| A | 32 | 251 | 214 | 498 | 496 | 792 | 930 |
| D | 50 | 361 | 321 | 561 | 668 | 737 | 924 |

44 μm* = SPD01 from Kink Co.; Diamond size: 325 Mesh (44 μm); Diamond spacing: 150 μm (density = ~44/mm$^2$); and Shape: fine.
180 μm** = AD3CG-181060 from Kinik Co.; Diamond size: nominally 180 μm; Diamond spacing: 150 μm (density = ~2.8/mm$^2$); and Shape: cubic-octahedral.

Figure 6:
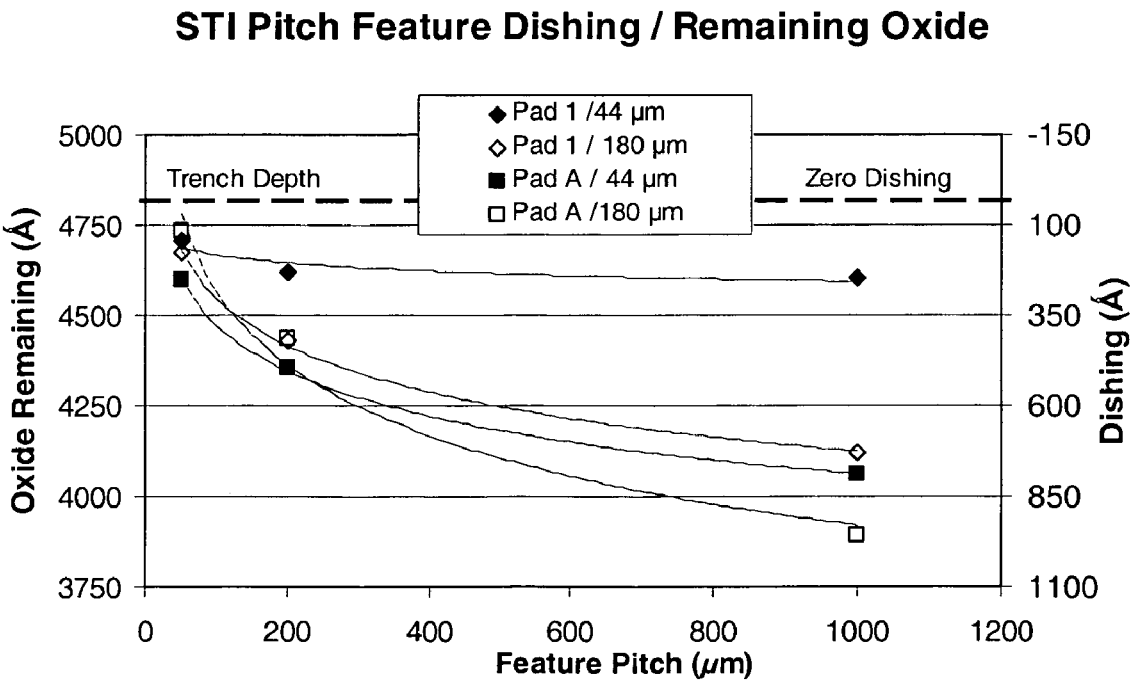
FIG. 6 represents a plot of dishing versus feature spacing for a conventional and an ultra-fine conditioner disk.

FIG. 6 illustrates that the small diamond conditioner provides excellent dishing over a large feature spacing range.

Table 4 illustrates that polishing pads with pore volumes less than 50 percent provide a greater improvement in dishing performance than polishing pads with pore volumes greater than 50 percent.

Example 3

Tables 5A and 5B include data which illustrates how varying the formulation factors of stoichiometry, pore size and pore volume percentage, in conjunction with the 44 μm conditioner, significantly improve dishing performance over an analogous pad conditioned with a more aggressive 180 μm diamond configuration. Polishing conditions, equipment and protocol as well as slurry and wafer type, used in generating the data below were the same as those described above for the data in Tables 3 and 4.

TABLE 5A

| Formulation | Stoichiometry | Pore size (μm) | Pore Volume (%) | 50 μm line Dishing* (Å) | 100 μm line Dishing* (Å) | 500 μm line Dishing* (Å) |
|---|---|---|---|---|---|---|
| 1 | 105 | 20 | 19 | 142 | 254 | 495 |
| 2 | 105 | 40 | 19 | −5 | 31 | 18 |
| B | 85 | 40 | 41 | 77 | 138 | 528 |
| C | 85 | 20 | 41 | 0 | 38 | 193 |

*Dishing represents result of subtracting 44 μm dishing value from 180 μm dishing value.

TABLE 5B

| Formulation | 50 μm line Dishing* (Å) | 100 μm line Dishing* (Å) | 500 μm line Dishing* (Å) | 50 μm line Dishing** (Å) | 100 μm line Dishing** (Å) | 500 μm line Dishing** (Å) |
|---|---|---|---|---|---|---|
| 1 | 194 | 316 | 402 | 336 | 570 | 897 |
| 2 | 318 | 485 | 651 | 313 | 516 | 669 |
| B | 244 | 511 | 581 | 321 | 649 | 1109 |
| C | 259 | 532 | 695 | 259 | 570 | 888 |

*Dishing represents the result using the 44 μm diamond conditioner.
**Dishing represents the result using the 180 μm diamond conditioner.

Tables 5A illustrates a general trend that decreasing pore size for low volume polishing pads improves dishing performance. Specifically, the pad 1 having 19 volume percent of 20 μm average pore diameter provided the largest decrease in dishing. Table 5B shows that best is achieved with low pore level and small pore size.

The invention claimed is:

1. A conditioned polishing pad suitable for planarizing at least one of semiconductor, optical and magnetic substrates, the polishing pad having a bulk ultimate tensile strength of at least 4,000 psi (27.6 MPa), a polishing surface and a polymeric matrix, the polymeric matrix having closed cell pores, the polishing surface having opened pores, the closed cell pores having an average diameter of 1 to 50 μm, being 1 to 40 volume percent of the polishing pad at a location below the polishing surface and the polishing surface having a natural porosity distribution with an exponential decay constant, $\tau$, of 1 to 5 μm, and a conditioner cutting characteristic texture having a half height half width, $W_{1/2}$, less than or equal to the value of $\tau$.

2. The polishing pad of claim 1 wherein the closed cell pores form 2 to 30 volume percent of the polymeric matrix at the location below the polishing surface.

3. The polishing pad of claim 1 wherein the polymeric matrix includes a polymer derived from difunctional or polyfunctional isocyanates and the polymeric polyurethane includes at least one selected from polyetherureas, polyisocyanurates, polyurethanes, polyureas, polyurethaneureas, copolymers thereof and mixtures thereof.

4. The polishing pad of claim 3 wherein the polymeric matrix is from the reaction product of a curative agent and an isocyanate-terminated polymer, the curative agent contains curative amines that cure the isocyanate-terminated reaction product and the isocyanate-terminated reaction product has an $NH_2$ to NCO stoichiometric ratio of 90 to 125 percent.

5. The polishing pad of claim 1 wherein the closed cell pores have an average diameter of 10 to 45 μm.

6. A conditioned polishing pad suitable for planarizing at least one of semiconductor, optical and magnetic substrates, the polishing pad having a bulk ultimate tensile strength of 4,000 to 14,000 psi (27.6 to 96.5 MPa), a polishing surface and a polymeric matrix, the polymeric matrix having closed cell pores, the polishing surface having opened pores, the closed cell pores having an average diameter of 1 to 50 μm, being 2 to 30 volume percent of the polishing pad at a location below the polishing surface and the polishing surface having a natural porosity distribution with an exponential decay constant, $\tau$, of 1 to 5 μm, and a conditioner cutting characteristic texture having a half height half width, $W_{12}$, less than or equal to the value of $\tau$.

7. The polishing pad of claim 6 wherein the closed cell pores form 2 to 25 volume percent of the polymeric matrix at the location below the polishing surface.

8. The polishing pad of claim 6 wherein the polymeric matrix includes a polymer derived from difunctional or polyfunctional isocyanates and the polymeric polyurethane includes at least one selected from polyetherureas, polyisocyanurates, polyurethanes, polyureas, polyurethaneureas, copolymers thereof and mixtures thereof.

9. The polishing pad of claim 8 wherein the polymeric matrix is from the reaction product of a curative agent and an isocyanate-terminated polymer, the curative agent contains curative amines that cure the isocyanate-terminated reaction product and the isocyanate-terminated reaction product has an $NH_2$ to NCO stoichiometric ratio of 90 to 125 percent.

10. The polishing pad of claim 6 wherein the closed cell pores have an average diameter of 10 to 45 μm.

* * * * *